United States Patent [19]

Paolino

[11] 4,381,819

[45] May 3, 1983

[54] FLUE HEAT RECLAIMER

[76] Inventor: Ralph J. Paolino, 615 Warwick Rd, Fairless Hills, Pa. 19030

[21] Appl. No.: 265,835

[22] Filed: May 21, 1981

Related U.S. Application Data

[63] Continuation of Ser. No. 75,657, Sep. 14, 1979, abandoned.

[51] Int. Cl.[3] ..... F24B 7/00; F28D 7/10; F28F 13/06

[52] U.S. Cl. ..... 165/156; 165/47; 165/122; 165/DIG. 2; 237/55

[58] Field of Search ..... 165/DIG. 2, 156, 184, 165/109.7, 47, 122; 237/55

[56] References Cited

U.S. PATENT DOCUMENTS

| | | | |
|---|---|---|---|
| 2,468,909 | 5/1949 | Yeager et al. | 237/55 |
| 2,503,595 | 4/1950 | Preston | 165/156 |
| 2,619,022 | 11/1952 | Hergenrother | 165/184 X |
| 2,756,032 | 7/1956 | Dowell | 165/156 |
| 2,879,976 | 3/1959 | Rose, Sr. | 165/122 |
| 3,362,058 | 1/1968 | Morris et al. | 165/184 X |
| 4,171,773 | 10/1979 | Preston | 165/DIG. 2 |
| 4,258,782 | 3/1981 | Kao | 165/184 X |
| 4,278,126 | 7/1981 | Skrzypek | 165/122 |

FOREIGN PATENT DOCUMENTS

| | | | |
|---|---|---|---|
| 207254 | 1/1940 | Switzerland | 165/156 |
| 567997 | 3/1945 | United Kingdom | 165/156 |

*Primary Examiner*—Sheldon J. Richter
*Attorney, Agent, or Firm*—Joseph W. Molasky & Assoc.

[57] ABSTRACT

A flue heat reclaimer is constructed to be mounted on the exterior of a flue duct of a heater and provide a spiral-shaped heat transfer passage extending around the flue duct. A fan causes air to flow through the heat transfer passage so that the temperature of this air is elevated by reason at its extended heat transfer relationship with the flue duct.

5 Claims, 8 Drawing Figures

FLUE HEAT RECLAIMER

This is a continuation of application Ser. No. 75,657 filed Sept. 14, 1979, now abandoned.

BACKGROUND AND SUMMARY OF THE INVENTION

The invention relates generally to flue heat reclaimers for use with home heaters or the like.

The present day devices in use today for reclaiming heat from the flues of home heaters or the like have several deficiencies. Such heat reclaimers involve an arrangement wherein a pluralty of heat transfer tubes are mounted to extend transversely across the flue duct passage. Because of the comparatively small air-hot surface contact, this arrangement does not provide sufficient heat transfer from the flue gases to the heat reclaimer. Moreover, the transversely extending heat transfer tubes provide an obstruction to the flow of the flue gases through the flue duct and permit soot to build up to restrict this flow when used with wood and oil stoves. Accordingly, the soot must be cleaned periodically in order to prevent the creation of a serious hazardous condition. Also, the soot buildup reduces the heat transfer effectiveness of the device. The use of above-described devices is prohibited in some states because of safety hazzards.

It is the general object of the invention to provide a flue heat reclaimer which overcomes the deficiencies or the present day devices described above. The flue heat reclaimer of the invention provides for a better heat transfer efficiency than the prior devices, and does not obstruct the flow of gases in the flue. In one construction in accordance with the invention the reclaimer is adapted to fit over the exterior of an existing flue duct. Thus, the flue heat reclaimer of the invention does not require cutting into the interior of the flue duct as is the case with the prior art devices. The flue heat reclaimer of the invention can also be pre-assembled and inserted as a section in the flue duct. Moreover, the flue heat reclaimer of the invention is less expensive to make and simpler to install than the prior art devices.

Briefly stated, the flue heat reclaimer of the invention comprises a spiral-shaped divider which fits over the flue duct with its inner edge adjacent thereto, and a cylindrical outer tube adapted to be mounted on the flue duct and having a diameter greater than the diameter of the flue duct, the divider being adapted to fit within the outer tube with its outer edge adjacent thereto. The flue heat reclaimer also is provided with end caps enclosing the ends of the outer tube. The end caps, the outer tube and the divider cooperate with the exterior of the flue duct to define a spiral-shaped heat exchange passage extending around the exterior of the flue duct. Fan means are provided to cause air to flow through the heat exchange passage so that the temperature of this flowing air is raised by reason of its extended heat exchange relationship with the exterior of the flue duct. The heat reclaimer is most desirably provided with a helical-shaped divider and means for restricting the air flow through the heat exchange passage in a manner to create turbulent flow and increase the heat exchange action that occurs.

DETAILED DESCRIPTION OF THE PREFERRED EMBODIMENT

Figure 1:
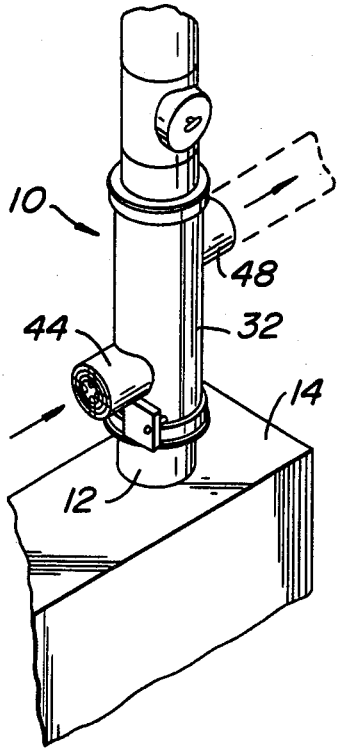
FIG. 1 is a perspective view showing a flue heat reclaimer in accordance with the invention installed on the flue duct of a home heater.

In FIG. 1 a flue heat reclaimer 10 in accordance with the invention is shown installed on a vertically extending cylindrical flue duct 12 of a home heater 14, which may be either a gas, oil or wood heater. It is to be noted that the flue heat reclaimer of the invention is usable with various types of heaters or the like including wood stoves and other sources of heat requiring a flue tube for the release of hot gases.

Figure 2:
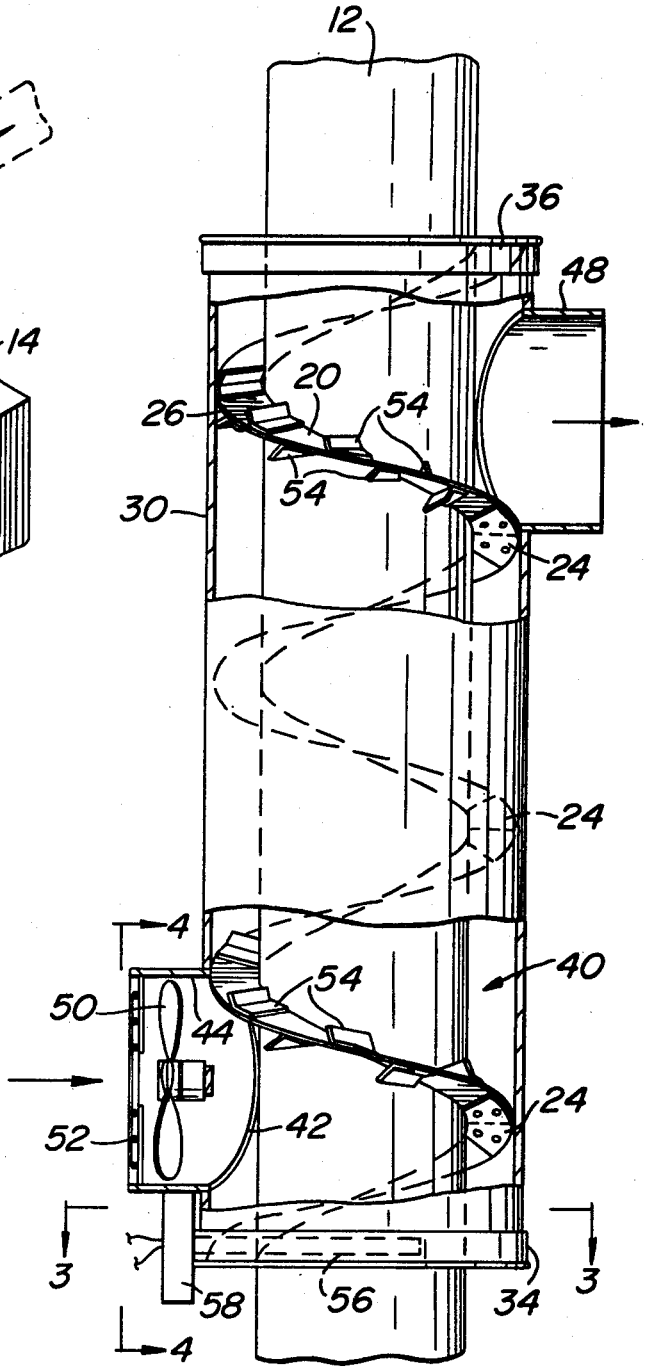
FIG. 2 is a fragmentary view, partly in section, showing the flue heat reclaimer of the invention.

In accordance with the invention, flue heat reclaimer 10 is adapted to be mounted on the exterior of the cylindrical flue duct 12. To this end, flue heat reclaimer 10 comprises a divider in the form of a helical-shaped vane 20 constructed to fit around flue duct 12 with its inner edge 22 adjacent to the exterior of flue duct 12, as is shown in FIG. 2. In the form of the invention shown in FIG. 2, helical-shaped vane 20 is constructed of a plurality of elliptical-shaped sections secured together at their ends by means of connecting plates 24.

A cylindrical outer tube 30 having a diameter greater than flue duct 12 is adapted to be mounted thereon to define an annular space between the exterior of flue duct 12 and the interior of outer tube 30 as is shown in FIG. 2. In the case of a typical six inch flue duct 12, outer tube 30 may be constructed from a nine inch diameter duct material. Outer tube 30 has a longitudinally extending seam whereby it can be bent open so that it can be fitted onto flue duct 12 into a position as shown in FIG. 2. It will be apparent that outer tube 30 may take other constructions which permit it to be mounted onto the exterior of the flue tube. For example, it may be made in two sections and secured in position by straps or the like.

Figure 3:
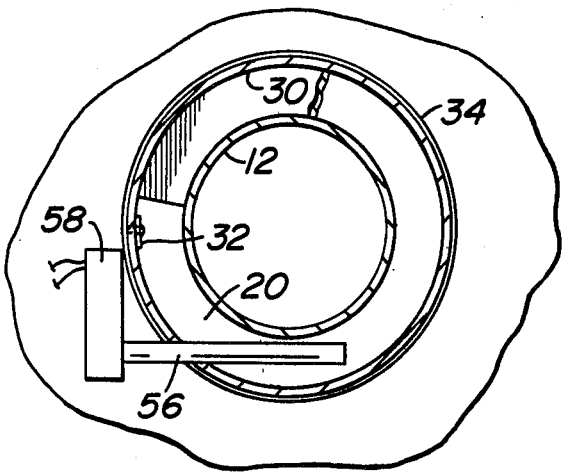
FIG. 3 is a sectional view taken on line 3—3 of FIG. 2.

Vane 20 has a width approximating that of the annular space between flue duct 12 and outer tube 30 and is adapted to fit within outer tube 30 with its outer edge 26 adjacent thereto as shown in FIG. 2. Vane 20 is positioned securely within outer tube 30 by means of a pair of angular-shaped tabs 32 at each end thereof. The tabs 32 are attached by suitable mounting screws to both vane 20 and the inner wall of outer tube 30 as is best shown in FIG. 3.

A first end cap 34 is adapted to fit over outer tube 30 to enclose the lower end thereof. A second end cap 30 is adapted to fit over outer tube 30 to enclose the upper end thereof. End cap 34 has a split construction so that it can be assembled over flue duct 12. End cap 36 has a similar split construction.

As is shown in FIG. 2, end caps 34 and 36, outer tube 30 and vane 20 cooperate with the exterior of flue duct 12 to define a helical-shaped heat exchange passage 40 extending around the exterior of flue duct 12.

The flue heat reclaimer is provided with an inlet to the lower end of heat exchange passage 40 and an outlet from the upper end thereof. The inlet comprises an opening 42 in the lower end of outer tube 30 cooperating with a cylindrical tube 44. The outlet comprises an opening 46 in the upper end of outer tube 30 cooperating with a cylindrical tube 48.

Figure 4:
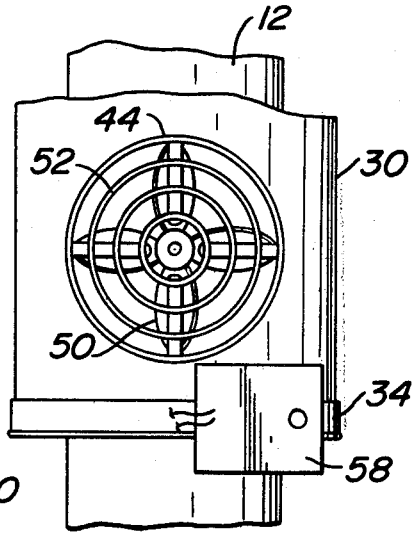
FIG. 4 is a sectional view taken on line 4—4 of FIG. 2.

There is provided fan means for causing air to flow sequentially from the inlet up through the heat exchange passage 40 to be discharged from the outlet at the upper end thereof. Such fan means comprises a fan 50 mounted within tube 44 and enclosed by a protective grill 52 as is shown in FIGS. 2 and 4.

In accordance with the invention there is provided means for obstructing or restricting the air flow through the heat exchange passage 40 so as to increase the residence time of the air travelling therethrough thereby increasing the amount of heat transfer. In the embodiment of the invention shown in FIGS. 1–4 the flow restricting means is in the form of a plurality of fins or baffles 54 mounted on vane 20 to extend outwardly therefrom into the heat exchange passage 40 to thereby cause turbulence in the air flow therethrough. Other types of flow restricting means will be described hereafter.

In the use of the flue heat reclaimer 10, the fan 50 will be operated to cause air to flow through the inlet opening 42 and upwardly through the heat exchange passage 40 to be discharged from the outlet opening 46 into tube 48. The cool air entering the heat exchange passage 40 will have its temperature raised as it passes therethrough by reason of the heat exchange relationship of this air with the flue duct 12 which is at an elevated temperature. The heated air can then be ducted by suitable means to the location which is to be heated by the flue heat reclaimer. In use, the helical divider provides an extended flow path and contact with more hot surface area for greater heat transfer efficiency as compared with the prior art devices. Moreover, the length of the divider is determined by the amount of heated surface area required to raise the temperature of the inlet air to the desired temperature above ambient. Also, the restricting means increases the residence time of the air to thereby increase the temperature thereof.

Temperature control means are provided for controlling operation of fan 50 in response to the temperature of the air in heat exchange passage 40. To this end, a temperature sensing means in the form of a thermocouple 50 is mounted to extend into heat exchange passage 40 near the inlet thereof. Thermocouple 50 is connected to a suitable control means 58 which is arranged to control operation of fan 50. Thermocouple 50 is set to start and stop fan 50 at predetermined temperature conditions sensed within the heat exchange passage 40.

Figure 5:
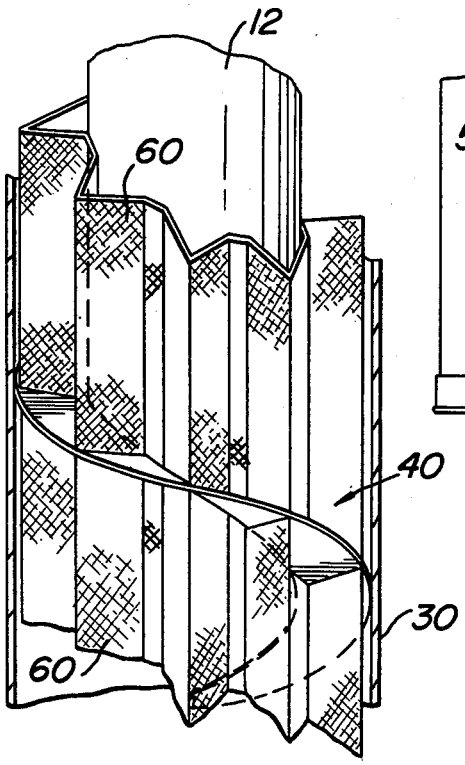
FIG. 5 is fragmentary view of an alternate construction in accordance with the invention.

The embodiment of the invention shown in FIG. 5 is similar to that shown in FIGS. 1–4 except that the fins or baffles are replaced by a mesh-like strip of expanded aluminum of the type used as gutter guards. Strip 60 is bent transversely at longitudinally spaced locations to form a undulated or zigzag shape in cross-section and is located within the helically extending heat exchange passage 40 as is shown in FIG. 5. The strip 60 fills the heat exchange passage to provide additional heat transfer surface area from which heat is recovered by the air flowing through the heat exchange passage. The strip 60 also functions as a means of restricting air flow.

Figure 8:
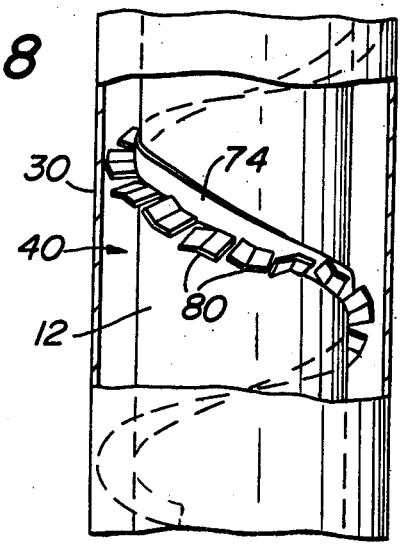
FIGS. 6–8 are fragmentary detail views of another alternate construction in accordance with the invention.
Figure 6:
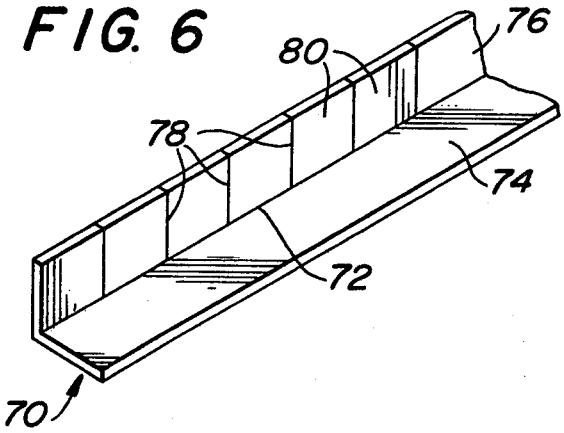
Figure 7:
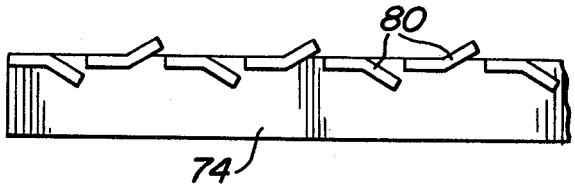

Another embodiment of the invention is shown in FIGS. 6, 7 and 8. In this embodiment of the invention the divider is formed by a strip 70 (best shown in FIG. 6) bent along its longitudinally extent at bend 72 to provide a first portion 74 which forms a flat bottom and a portion 76 provided with slits 78 to form a plurality of tabs 80. As shown in FIG. 7, the tabs 80 are split and bent away from the flat portion at an angle to provide obstruction to flow. Tabs 30, in effect, serve define the heat exchange passage. Strip 70 is mounted on the flue tube 12 by anchoring one end thereof thereto and winding the strip 60 in a helical configuration around the flue tube 12 and then anchoring the outer end to the flue tube 12. The mounted structure takes a position as shown in FIG. 8 which shows that the tab portion 80 define a helically extending vane and also provide flow restricting means to increase the residence time of the air moving through the heat exchange passage 40.

As described above, the reclaimer 10 is particularly adapted for mounting on the exterior of an existing flue duct. The flue heat reclaimer of the invention can also be pre-assembled and inserted as a section in the flue duct. In this case there is provided a cylindrical inner flue duct matching the existing flue duct and the divider and other elements are pre-assembled thereon. The matching inner flue duct replaces the corresponding portion of flue duct 12. Also, the pre-assembled unit does not require the splitting of the end caps 34 and 36. In both the pre-assembled and the attachment units there is no obstruction in the path of the flue gases.

Other changes may be made in the construction and arrangement of parts without departing from the scope of the invention as defined in the claims.

What is claimed is:

1. For use with a home heater or the like having a cylindrical flue duct for the hot flue gases from the heater, a flue heat reclaimer comprising a spiral-shaped divider adapted to fit over said flue duct with its inner edge adjacent thereto, a cylindrical outer tube adapted to be mounted on said flue duct and having a diameter greater than the diameter of said flue duct, said divider being adapted to fit within said outer tube with the outer edge of the divider adjacent thereto, a first end cap enclosing one end of said outer tube, a second end cap enclosing the other end of said outer tube, said end caps, said outer tube, and said divider cooperating with the exterior of said flue duct to define a spiral-shaped heat exchange passage extending around the exterior of said flue duct, means providing an inlet to one end of said heat exchange passage, means providing an outlet from the other end of said heat exchange passage, and fan means for causing air to flow successively from said inlet means through said heat exchange passage and said outlet means whereby the temperature of the air flowing through said heat exchange passage is raised by means of its extended heat exchange relationship with the exterior of said flue duct, said divider being made of a strip bent longitudinally with one portion extending along the exterior of said flue duct and the other portion comprised of tabs defining the heat exchange passage.

2. A flue heat reclaimer according to claim 1 wherein said strip is anchored at its ends only to said flue duct.

3. For use with a home heater or the like having a cylindrical flue duct for the hot flue gases from the heater, a flue heat reclaimer comprising a spiral-shaped divider adapted to fit over said flue duct with its inner edge adjacent thereto, a cylindrical outer tube adapted to be mounted on said flue duct and having a diameter greater than the diameter of said flue duct, said divider being adapted to fit within said outer tube with the outer edge of the divider adjacent thereto, a first end cap enclosing one end of said outer tube, a second end cap enclosing the other end of said outer tube, said end caps, said outer tube, and said divider cooperating with the exterior of said flue duct to define a spiral-shaped heat exchange passage extending around the exterior of said flue duct, means providing an inlet to one end of said heat exchange passage, means providing an outlet from the other end of said heat exchange passage, means restricting air flow through said spiral-shaped passage, and fan means for causing air to flow successively from said inlet means through said heat exchange passage and said outlet means whereby the temperature of the air flowing through said heat exchange passage is raised by means of its extended heat exchange relationship with the exterior of said flue duct, said divider being made of a strip bent longitudinally with one portion extending along the exterior of said flue duct and the other portion comprised of tabs defining the heat exchange passage and said restricting means.

4. A flue heat reclaimer according to claim 3 wherein said end caps have a split construction so that they can be assembled over said flue duct.

5. A flue heat reclaimer according to claim 3 including means responsive to the temperature in said heat exchange chamber for controlling operation of said fan means including a temperature sensor mounted to sense the temperature of the air flowing through said heat exchange chamber.

* * * * *